US006421925B1

(12) United States Patent
Wonderley

(10) Patent No.: US 6,421,925 B1
(45) Date of Patent: Jul. 23, 2002

(54) SINGLE PIECE SPRING CLIP FOR RAZOR

(75) Inventor: Jeffrey W. Wonderley, Ft. Defiance, VA (US)

(73) Assignee: American Society Razor Company, Verona, VA (US)

( * ) Notice: Subject to any disclaimer, the term of this patent is extended or adjusted under 35 U.S.C. 154(b) by 0 days.

(21) Appl. No.: 09/584,394

(22) Filed: Jun. 1, 2000

(51) Int. Cl.[7] ..... B26B 21/22; B26B 21/30
(52) U.S. Cl. ..... 30/532
(58) Field of Search ..... 30/530, 531, 522, 30/533, 47

(56) References Cited

U.S. PATENT DOCUMENTS 4,392,303 A 7/1983 Ciaffone

FOREIGN PATENT DOCUMENTS

| | | | |
|---|---|---|---|
| EP | 0203527 A1 | | 5/1986 |
| EP | 0951971 A1 | | 10/1999 |
| GB | 2081165 A | | 2/1982 |
| GB | 2172236 | * | 9/1986 |
| WO | WO99/04938 | | 2/1999 |

* cited by examiner

*Primary Examiner*—Douglas D. Watts
(74) *Attorney, Agent, or Firm*—McDermott, Will & Emery

(57) ABSTRACT

A spring clip is disclosed for securing and releasing a razor cartridge to and from a razor handle. The spring clip includes a pair of cartridge seats and a cartridge release mechanism of unitary construction. The cartridge seats are designed to receive a razor cartridge thereon, and can be positioned to allow removal or exchange of a razor cartridge. A razor that incorporates such a spring clip is also disclosed.

20 Claims, 2 Drawing Sheets

SINGLE PIECE SPRING CLIP FOR RAZOR

BACKGROUND OF THE INVENTION

1. Technical Field

The present invention relates to wet shaving and, more particularly, to a clip for attaching a razor cartridge to a razor handle.

2. Description of the Related Art

Modem wet shaving razors are often ergonomically designed to fit comfortably in a shaver's hand, while providing a smooth and close shave. Such razors are constructed of materials having properties such as high quality and durability. Manufacturing costs, however, prevent such razors from being used in a disposable manner. Rather, disposable razor cartridges are provided for attachment to the razor handle. The razor cartridges typically comprise one or more razor blades encased in a multi-component cap member. Additionally, various elements can be added to the razor cartridge to improve shaving quality. For example, the razor cartridge can include a guard member to help reduce cuts, and/or a lubrication strip to reduce irritation.

The razor cartridges are designed such that they are selectively removable from the handle. More particularly, a shaver attaches a razor cartridge to the handle and shaves in a normal manner. After repeated use, however, the blades on the razor cartridge will become dull, or otherwise ineffective. The shaver then disposes the used razor cartridge and attaches a new razor cartridge to the handle. For added convenience, multiple razor cartridges are packaged in a dispenser that is easily engageable by the handle. The dispensers include a plurality of guides corresponding to the number razor cartridges being housed. The dispenser provides as a relatively sturdy platform while attaching the handle to the razor cartridge, and the guides allow easy removal of the razor cartridges once the handle has been attached.

Razor handles and cartridges are specifically designed to include corresponding mating components that facilitate a safe and secure connection. For example, different manufacturers incorporate unique locking arrangements for attaching their razor cartridges to the handle. Accordingly, one manufacturer's razor cartridge generally will not work with another manufacturer's handle. The locking arrangements are often in the form of channels or female components disposed on the razor cartridge, and corresponding projections, or male components, attached to the handle. The projections are movable within the handle, and biased to a position that engages the channel of the razor cartridge and locks it to the handle. A release mechanism is provided to place the projections in an unlocked position whereby the razor cartridge can be detached.

The improvements in quality of modem wet shave razors, have also increased the number of components used to manufacture such razors. Consequently, the costs associated with manufacturing razors have increased. One way to decrease manufacturing costs is to reduce the number of components used in the razor. Accordingly, the material costs as well as assembly time are reduced, resulting in an overall decrease in price.

The locking mechanism used in the razor handle are oftentimes a source of complexity in manufacturing razors. One problem associated with such mechanisms is that they are often constructed from a plurality of individual components that must be connected for interoperability during the assembly process. For example, various types of springs are used in conjunction with rigid members to retain the locking mechanism in the locked position. Tabs can be provided at a location that allows a shaver to apply forces that oppose the bias created by the spring member to the arms, thereby positioning the locking arrangement in the unlocked position. During the assembly process, each component must be appropriately positioned within the handle in order to ensure proper engagement and disengagement of the razor cartridge. The number of components used in the locking mechanism directly effects the amount of time required to assembly the razor, hence effecting the manufacturing costs as well.

Accordingly, there exists a need for a locking mechanism for a wet shave razor having a reduced number of components. There also exists a need for a locking mechanism for a wet shave razor that simplifies assembly of the razor handle.

SUMMARY OF THE INVENTION

An advantage of the present invention is a locking mechanism having a reduced number of components.

Another advantage of the present invention is a locking mechanism that simplifies assembly of a razor handle.

These and other advantages are achieved by the present invention wherein a locking mechanism is provided in the form of clip of unitary construction that can be placed within a razor handle to selectively attach and release a razor cartridge.

According to one aspect of the invention, a spring clip is provided for selectively securing and releasing a razor cartridge to and from a razor handle. The spring clip includes a pair of cartridge seats and a cartridge release mechanism that are of unitary construction. The cartridge seats are designed to receive the razor cartridge thereon, and can occupy two different positions. In the first position, the cartridge seats engage and securely retain the razor cartridge. In the second position, the cartridge seats disengage the razor cartridge, thereby allowing its removal or exchange. The cartridge release mechanism is operably connected to the cartridge seats for placing them in the first and second positions. Such an arrangement provides an effective way to attach and release the razor cartridge.

According to another aspect of the invention, a razor is provided for performing wet shaving operations. The razor includes a handle, a cartridge holder, a razor cartridge, and a spring clip. The cartridge holder is attached to one end of the handle, and the spring clip is disposed within the cartridge holder to selectively secure and release the razor cartridge. The spring clip includes a pair of cartridge seats designed to receive the razor cartridge thereon. Additionally, the cartridge seats can be placed in two positions to either secure or release the razor cartridge. A cartridge release mechanism is operably connected to the cartridge seats for placing them in the first and second positions. The cartridge seats and the cartridge release mechanism are of unitary construction. Such an arrangement advantageously allows a reduction in the number of parts used to construct a razor that utilizes disposable cartridges. Accordingly, material and manufacturing costs can be reduced.

Additional advantages and novel features of the present invention will be set forth in-part in the description which follows, and in part will become apparent to those skilled in the art upon examination of the following, or may be learned by practice of the present invention. The embodiments shown and described provide an illustration of the best mode contemplated for carrying out the present invention. The invention is capable of modifications in various obvious respects, all without departing from the spirit and scope thereof. Accordingly, the drawings and description are to be regarded as illustrative in nature, and not as restrictive. The advantages of the present invention may be realized and attained by means of the instrumentalities and combinations particularly pointed out in the appended claims.

BRIEF DESCRIPTION OF THE DRAWINGS

Reference is made to the attached drawings, wherein elements having the same reference numeral designations represent like elements throughout and wherein.

DETAILED DESCRIPTION OF THE ILLUSTRATED EMBODIMENTS

The spring clip of the present invention advantageously provides a design for releasing razor cartridges from a handle, and utilizes a minimum number of parts. Accordingly, the cost of manufacturing such a spring clip can be reduced. Further, the overall material costs and assembly time required to manufacture the razor handle incorporating such a spring clip can be reduced.

Figure 1:
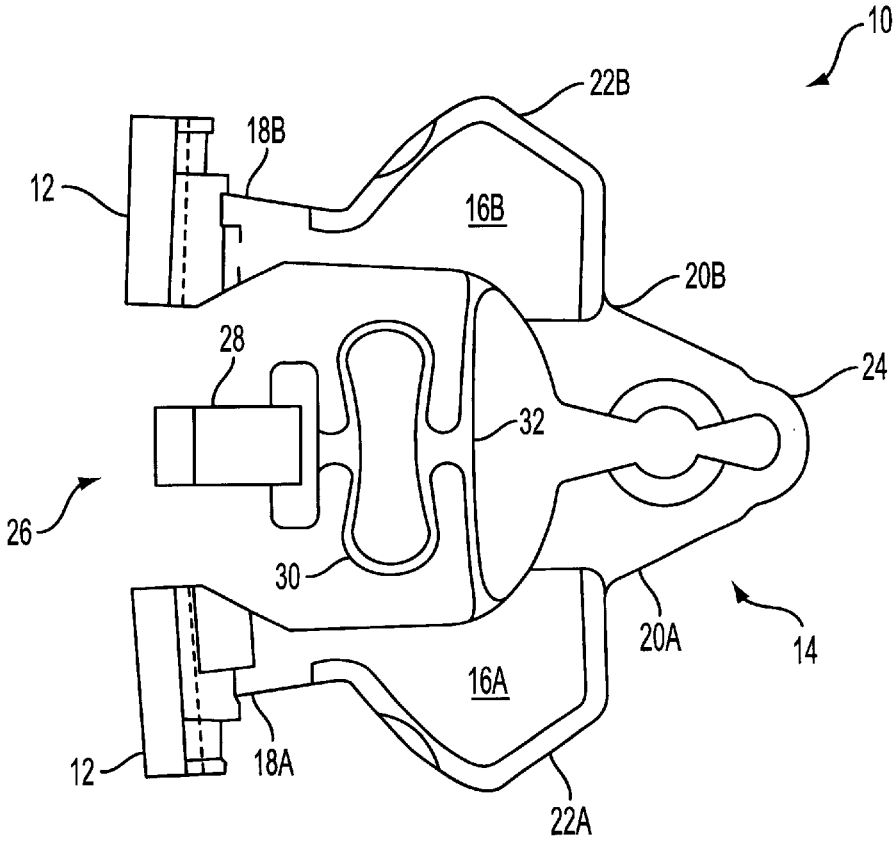
FIG. 1 is a perspective view of a spring clip constructed in accordance with an embodiment of the present invention.
Figure 2:
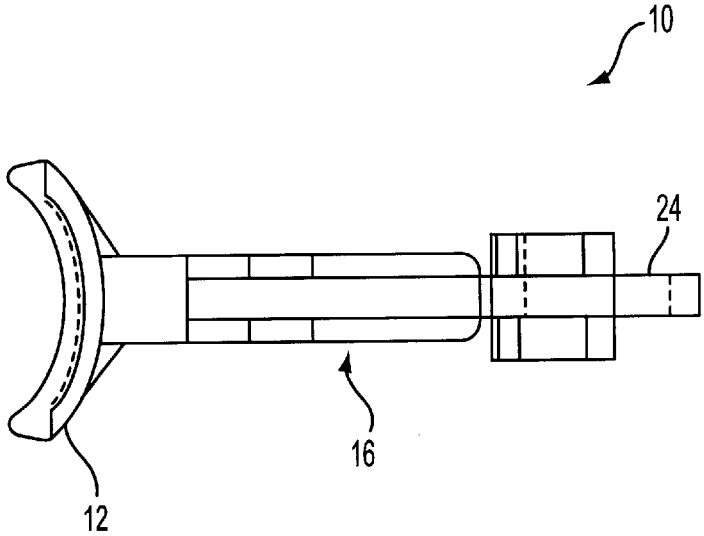
FIG. 2 is a top plan view of the spring clip.

Turning now to the drawings, and initially to FIGS. 1 and 2, there is shown a spring clip 10, for releasing a razor cartridge from a razor handle, constructed in accordance with an embodiment of the present invention. The spring clip 10 is in the form of a pair of cartridge seats 12 and a cartridge release mechanism 14 that is operatively connected to the cartridge seats 12.

As illustrated in FIGS. 1 and 2, the cartridge seats 12 and the cartridge release mechanism 14 are formed from a single piece of material in order to reduce costs. In other words, the spring clip 10 is configured as a single part for assembly purposes. Various types of materials and manufacturing processes can be incorporated for producing the spring clip. For example, the spring clip 10 can be constructed from high strength and durable plastics, and can be manufactured using various processes such as, for example, injection molding.

Each cartridge seat 12 includes a prescribed curvature configured for engaging a particular type of razor cartridge. Such razor cartridges include, but are not limited to, moveable blade razor cartridges such as those described in U.S. Pat. Nos. 5,341,571; 5,347,714; and 5,517,760, commonly assigned to the present assignee. The cartridge seats 12 are designed for receiving the razor cartridge thereon and selectively securing or releasing the razor cartridge. More particularly, the cartridge seats 12 are capable of occupying one of two positions. In the first position, the cartridge seats 12 engage the razor cartridge in a substantially immovable position so that shaving activities can be performed. In the second position, the cartridge seats 12 disengage from the razor cartridge and allow the razor cartridge to be removed and/or replaced.

The cartridge release mechanism 14 is operatively connected to the cartridge seats 12 and provides the function of placing the cartridge seats 12 in the first and second positions. The cartridge release mechanism 14 includes a first and second arm 16A, 16B (collectively 16). Each arm 16 includes a first end 18A, 18B (collectively 18) and a second end 20A, 20B (collectively 20). A release pad portion 22A, 22B (collectively 20) is formed at the second end 18A, 18B of the first and second arms 16A, 16B. As illustrated in FIGS. 1 and 2, a connector portion 24 is provided for attaching the first and second arms 16A, 16B together, thereby maintaining the unitary nature of the spring clip 10. The connector portion 24 includes an opening that allows the first and second arms 16A, 16B to be resiliently positionable.

According to the disclosed embodiment of the invention, a cartridge ejector 26 is provided for forcing the razor cartridge off the cartridge seats 12. The cartridge ejector 26 includes a cartridge support member 28, a spring member 30, and a cartridge support actuator 32. The cartridge support member 28 is positioned between the two cartridge seats 12, and includes a first end and a second end. The first end is placed in contact with the razor cartridge (not shown), when and if a razor cartridge is secured to the cartridge seats 12. The spring member 30 is attached to the second end of the cartridge support member 28 and allows a predetermined level of resilience for attaching the razor cartridge to the cartridge seats 12. The amount of resilience allowed can vary depending on the specific application and the manner in which the razor cartridge engages the cartridge seats 12. The cartridge support actuator 32 is in the form of an elongated member having first and second ends that are in contact with the first and second arms 16A, 16B of the cartridge release mechanism 14. Additionally, the cartridge support actuator 32 is attached to the spring member 30 at a location opposite of the cartridge support member 28.

As suggested by FIGS. 1 and 2, operation of the spring clip 10 is achieved by means of various force transfers. Specifically, force applied to the first and second release tabs 22A, 22B causes the cartridge support actuator 32 to bend in the direction of the spring member 30. Accordingly, the cartridge support actuator 32 functions as a leaf spring and is attached to the first and second arms 16A, 16B with a predetermined curvature in order to prevent movement in the direction away from the spring member 30.

The force generated by the cartridge support actuator 32 causes the spring member 30 to push the cartridge support member 28 against the razor cartridge. As previously stated, the spring member 30 is configured to withstand a predetermined level of compression. Hence, the force applied by the cartridge support actuator 32 is not directly transferred to the cartridge support member 28. Rather, the spring member 30 absorbs the force by compression and transfers a moderated force to the cartridge support member 28. Such a configuration prevents the razor cartridge from being rapidly rejected from the cartridge seats 12.

When the release tab portions 22 are depressed, the first and second arms 16 are moved to position with the cartridge seats 12 such that the razor cartridge is unlocked. As previously stated, when in the locked position, the cartridge seats 12 engage with the razor cartridge to form a substantially immovable combination. When placed in the unlocked position, the cartridge seats 12 disengage with the razor cartridge to allow free movement of the razor cartridge. Hence, when the cartridge support member 28 is forced against the razor cartridge, the razor cartridge can be gently released.

Figure 3:
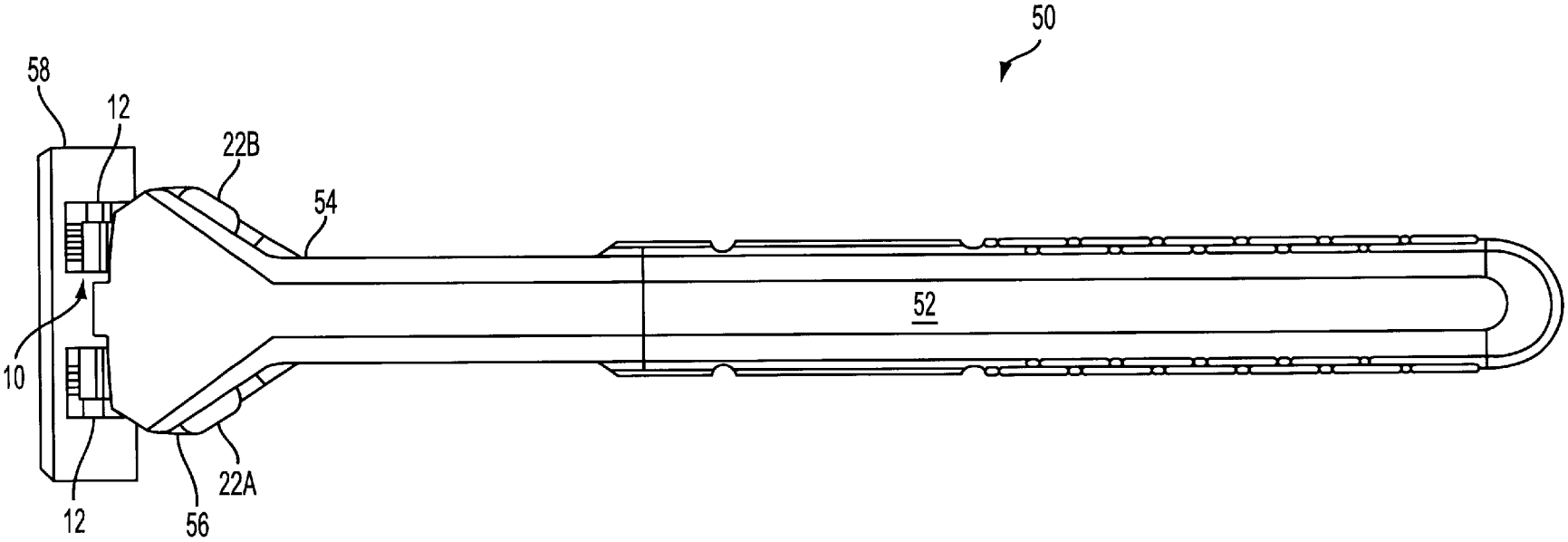
FIG. 3 is a perspective view of a razor having a spring clip constructed in accordance with the present invention.

FIG. 3 illustrates a razor 50 incorporating a spring clip 10 constructed in accordance with the present invention. The razor 50 includes a handle 52, a cartridge holder 56, and a razor cartridge 58. The handle 52 can be constructed according to various designs such as those disclosed in U.S. Pat. No. Des. 380,866, Des. 389,955; Des. 392,416, commonly assigned to the present assignee. Referring additionally to FIGS. 1 and 2, the cartridge holder 56 is attached to a first end 54 of the handle 50 and includes a hollow interior within which the spring clip 10 is disposed. According to one embodiment of the present invention, the interior of the cartridge holder 56 can include various channels (not shown) designed to retain the spring clip 10 without obstructing its operation. Alternatively, various retaining structures, such as, for example, a pin structure, can be used to retain the spring clip 10 while allowing the release tab portions 22 to be depressed for releasing the razor cartridge 58.

As shown in FIG. 3, the release tab portions 22 extend outside the cartridge holder 56. Similarly, the cartridge seats 12 extend outside of the cartridge holder 56 in order to retain the razor cartridge 58. The location of the release 22 tab portions allow a shaver to simultaneously exert force on both of the release tab portions 22, hence causing release of the razor cartridge 58.

In the previous descriptions, numerous specific details are set forth, such as specific materials, structures, processes, etc., in order to provide a thorough understanding of the present invention. However, as one having ordinary skill in the art would recognize, the present invention can be practiced without resorting to the details specifically set forth. In other instances, well known processing structures have not been described in detail in order not to unnecessarily obscure the present invention.

Only the preferred embodiment of the invention and an example of its versatility are shown and described in the present disclosure. It is to be understood that the invention is capable of use in various other combinations and environments and is capable of changes or modifications within the scope of the inventive concept as expressed herein.

What is claimed is:

1. A spring clip for selectively securing and releasing a razor cartridge to and from a razor handle, said spring clip comprising:

a pair of cartridge seats, said cartridge seats being positionable in one of a first position for securing a razor cartridge and a second position;

a cartridge release mechanism operably connected to said cartridge seats for placing said cartridge seats in said first and second positions, said release mechanism adapted to be disposed within a razor handle; and a cartridge ejector connected to said cartridge release mechanism;

said cartridge seats and said cartridge release mechanism being of unitary construction.

2. The spring clip of claim 1, wherein said cartridge ejector comprises:

a cartridge support member positioned between each of said cartridge seats, said cartridge support member having a first end in contact with the razor cartridge and a second end;

a spring member attached to said cartridge support member; and a cartridge support actuator connected to said spring member and said cartridge release mechanism.

3. The spring clip of claim 1, wherein said cartridge release mechanism comprises:

a first arm having a first end and a second end;

a first release tab portion formed at the second end of said first arm;

a second arm having a first end and a second end;

a second release tab portion formed at the second end of said second arm; and a connector portion that attaches the second end of said first arm to the second end of said second arm;

whereby force applied simultaneously to said first and second release tabs positions said cartridge seats in said second position and moves said cartridge support member to eject a razor cartridge.

4. The spring clip of claim 3, further comprising:

a cartridge support member positioned between each of said cartridge seats, said cartridge support member having a first end adapted to contact a razor cartridge;

a spring member attached to said cartridge support member; and a cartridge support actuator connected to said spring member and said cartridge release mechanism.

5. The spring clip of claim 4, wherein said cartridge support actuator comprises a leaf spring.

6. The spring clip of claim 4, wherein said spring member comprises a helical spring.

7. The spring clip of claim 4, wherein said spring member comprises a hollow resilient member.

8. A razor comprising:

a handle including a first end;

a cartridge holder attached to the first end of said handle;

a razor cartridge; and a spring clip disposed within said cartridge holder comprising:

a pair of cartridge seats, said cartridge seats being positionable in one of a first position and a second position;

a cartridge release mechanism operably connected to said cartridge seats; and a cartridge ejector connected to said cartridge release mechanism;

said cartridge seats and said cartridge release mechanism being of unitary construction.

9. The razor of claim 8, further comprising a cartridge ejector including:

a cartridge support member positioned between each of said cartridge seats, said cartridge support member having a first end in contact with said razor cartridge;

a spring member attached to said cartridge support member; and a cartridge support actuator connected to said spring member and said cartridge release mechanism.

10. A spring clip for selectively securing and releasing a razor cartridge to and from a razor handle, said spring clip comprising:

a pair of cartridge seats for receiving the razor cartridge thereon, said cartridge seats being positionable in one of a first position for securing the razor cartridge and a second position for releasing the razor cartridge;

a cartridge release mechanism operably connected to said cartridge seats for placing said cartridge seats in said first and second positions, said release mechanism being disposed within the razor handle; and a cartridge ejector connected to said cartridge release mechanism;

said cartridge seats and said cartridge release mechanism being of unitary construction.

11. The spring clip of claim 10, wherein said cartridge ejector comprises:

a cartridge support member positioned between each of said cartridge seats, said cartridge support member having a first end in contact with the razor cartridge;

a spring member attached to said cartridge support member; and a cartridge support actuator connected to said spring member and said cartridge release mechanism for placing a predetermined amount of force on said cartridge support member and ejecting the razor cartridge from said cartridge seats when said release mechanism places said cartridge seats in said second position.

12. The spring clip of claim 10, wherein said cartridge release mechanism comprises:

a first arm having a first end and a second end;

a first release tab portion formed at the second end of said first arm;

a second arm having a first end and a second end;

a second release tab portion formed at the second end of said second arm; and a connector portion that attaches the second end of said first arm to the second end of said second arm;

whereby force applied simultaneously to said first and second release tabs positions said cartridge seats in said second position and moves said cartridge support member to eject a razor cartridge.

13. The spring clip of claim 12, further comprising:

a cartridge support member positioned between each of said cartridge seats, said cartridge support member having a first end adapted to contact a razor cartridge;

a spring member attached to said cartridge support member; and a cartridge support actuator connected to said spring member and said cartridge release mechanism for placing a predetermined amount of force on said cartridge support member and ejecting a razor cartridge from said cartridge seats when said release mechanism places said cartridge seats in said second position.

14. The spring clip of claim 13, wherein said cartridge support actuator comprises a leaf spring.

15. The spring clip of claim 13, wherein said spring member comprises a helical spring.

16. The spring clip of claim 13, wherein said spring member comprises a hollow resilient member.

17. A razor comprising:

a handle including a first end;

a cartridge holder attached to the first end of said handle;

a razor cartridge; and a spring clip disposed within said cartridge holder for selectively securing and releasing said razor cartridge, said spring clip comprising:

a pair of cartridge seats for receiving said razor cartridge thereon, said cartridge seats being positionable in one of a first position for securing the razor cartridge and a second position for releasing the razor cartridge;

a cartridge release mechanism operably connected to said cartridge seats for placing said cartridge seats in said first and second positions; and a cartridge ejector connected to said cartridge release mechanism; said cartridge seats and said cartridge release mechanism being of unitary construction.

18. The razor of claim 17, further comprising a cartridge ejector including:

a cartridge support member positioned between each of said cartridge seats, said cartridge support member having a first end in contact with said razor cartridge and a second end;

a spring member attached to said cartridge support member; and a cartridge support actuator connected to said spring member and said cartridge release mechanism for placing a predetermined amount of force on said cartridge support member and ejecting said razor cartridge from said cartridge seats when said release mechanism places said cartridge seats in said second position.

19. A spring clip for selectively securing and releasing a razor cartridge to and from a razor handle, said spring clip comprising:

a pair of cartridge seats, said cartridge seats being positionable in one of a first position for securing a razor cartridge and a second position; and a cartridge release mechanism operably connected to said cartridge seats for placing said cartridge seats in said first and second positions without translation of said spring clip along a longitudinal axis of a razor handle, said release mechanism adapted to be substantially enclosed by a razor handle;

said cartridge seats and said cartridge release mechanism being of unitary construction.

20. A razor comprising:

a handle including a first end;

a cartridge holder attached to the first end of said handle;

a razor cartridge; and a spring clip substantially enclosed by said cartridge holder comprising:

a pair of cartridge seats, said cartridge seats being positionable in one of a first position and a second position without translation of the spring clip along a longitudinal axis of the razor handle; and a cartridge release mechanism operably connected to said cartridge seats; said cartridge seats and said cartridge release mechanism being of unitary construction.

* * * * *